US005211760A

United States Patent [19]

Kedarnath

[11] Patent Number: 5,211,760

[45] Date of Patent: May 18, 1993

[54] PAPER CLEANER SUBSYSTEM

[75] Inventor: N. Kedarnath, Fairport, N.Y.

[73] Assignee: Xerox Corporation, Stamford, Conn.

[21] Appl. No.: 868,440

[22] Filed: Apr. 15, 1992

[51] Int. Cl.[5] ..... G03G 21/00

[52] U.S. Cl. ..... 134/1; 15/1.51; 355/296; 355/30

[58] Field of Search ..... 355/296, 308, 309, 30, 355/215; 15/1.51; 134/1; 118/652

[56] References Cited

U.S. PATENT DOCUMENTS

| | | | |
|---|---|---|---|
| 2,576,882 | 11/1951 | Koole et al. | 15/1.51 |
| 3,404,418 | 10/1968 | Fantuzzo | 15/1.51 |
| 3,970,905 | 7/1976 | Itoh et al. | 317/262 |
| 3,981,498 | 9/1976 | Fletcher | 271/193 |
| 4,001,838 | 1/1977 | Maddox | 15/256.51 |
| 4,370,050 | 1/1983 | Matsui et al. | 15/1.5 R |
| 4,744,833 | 5/1988 | Cooper et al. | 15/1.5 R |
| 4,750,018 | 6/1988 | Gooray et al. . | |
| 4,796,058 | 1/1989 | Yamakoshi | 355/29 |
| 4,835,808 | 6/1989 | Hahne et al. | 15/1.5 R |
| 4,864,461 | 9/1989 | Kasahara | 361/234 |
| 5,003,325 | 3/1991 | Bibl | 346/136 |
| 5,008,968 | 4/1991 | Preston | 15/1.51 |
| 5,028,959 | 7/1991 | Gooray | 355/215 |

FOREIGN PATENT DOCUMENTS 1082910 9/1967 United Kingdom ..... 15/1.51

OTHER PUBLICATIONS

Patent Abstracts of Japan, vol. 14, No. 264 (P1057), Abstract Pub. Date Jun. 7, 1990, Jap. Doc 02-73285, Pub. Mar. 13, 1990.

Patent Abstracts of Japan, vol. 13, No. 299 (M874), Abs. Pub. Date Jul. 11, 1989, Jap. Doc. 01-87442, Pub. Mar. 31, 1989.

Patent Abstracts of Japan, vol. 10, No. 162 (P466), Abs. Pub. Date Jun. 10, 1986, Jap. Doc. 61-14648, Pub. Jan. 22, 1986.

*Primary Examiner*—Richard L. Moses

*Attorney, Agent, or Firm*—Tamera L. Fair

[57] ABSTRACT

An insulative belt having a conductive pattern. A potential difference is applied to the conductive pattern on the insulative belt creating an attractive force that is exerted on the small particles of paper debris. This attractive force holds the paper fibers and paper dust on the insulative belt for subsequent removal, while allowing the cleaned paper sheet to move on through the electrophotographic system.

10 Claims, 3 Drawing Sheets

PAPER CLEANER SUBSYSTEM

BACKGROUND OF THE INVENTION

This invention relates generally to electrophotographic printers and copiers, and more particularly, concerns removing paper fibers and dust from copier paper.

Paper transport mechanisms in photocopiers usually employ several pairs of rollers. The paper sheet is handed from roller to roller as it moves through the photocopier. Although this method works well for transporting paper, the contact between the rollers and the paper sheet causes abrasion of the paper sheet. The paper sheet abrasion creates dust and paper fibers that contaminate the xerographic engine and causes copy-quality problems. An objective of the present invention is to remove the paper dust and fibers from the paper sheet before it enters the transfer zone of the xerographic engine.

The following disclosures may be relevant to various aspects of the present invention and may be briefly summarized as follows:

U.S. Pat. No. 3,970,905 to Itoh et al. discloses an electric field curtain system for use in transportation, repulsion, confinement, and brushing away of powder particles. The electric field curtain system includes a plurality of thin linear electrodes embedded in an insulator layer in parallel to each other so that curved electric lines of force which are outwardly convex are produced on the surface of the insulator layer.

U.S. Pat. No. 3,981,498 to Fletcher discloses a paper sheet transport wherein a non-uniform charge is applied to a surface of a sheet material and/or a surface of a conveying belt so that higher electrostatic forces between the sheet material and the conveying belt are obtained. The nonuniform charge pattern is applied using a textured roller.

U.S. Pat. No. 4,864,461 to Kasahara discloses a machine unit having an electrostatic retention means comprising a conveying belt (or roller), a pair of electrodes and a power source circuit for supplying positive and negative charges to the pair of electrodes while changing the polarity thereof. The power source circuit includes a DC power source having first and second terminals and switching means connected between the terminals and the pair of electrodes for alternately reversing the electrical polarity of the electrodes.

U.S. Pat. No. 5,003,325 to Bibl discloses an electric field paper stabilizing system including a continuous transport belt having a conductive surface conformably coated with a minimally thin dielectric material of high dielectric strength and permitivity. A recording medium such as electrostatic writing paper has a conductive surface adjacent the dielectric coating on the conductive transport belt. Electrodes are provided in the dielectric coating for holding the paper at ground potential. A differential potential is applied between the back side of the paper and the conductive transport whereby the paper and belt function as parallel conductive plates of a capacitor. The electric field developed between the conductive paper and the belt provides a strong hold down force which immovably registers the paper to the belt.

U.S. Pat. No. 5,008,968 to Preston discloses a sheet material cleaning machine comprising a conveyor for moving a sheet of material to be cleaned along a predetermined path through first and second cleaning stations. At the first cleaning station, portions of the surfaces of the sheet exposed by the conveyor are cleaned by passing the sheet between ionization bars which neutralize static electrical charges on the sheet. Subsequently, the sheet is conveyed between air jets and rotary brushes to clean the exposed surfaces of the sheet. Portions of the sheet not exposed at the first cleaning station are exposed at the second cleaning station where a similar cleaning process is repeated. As the sheet leaves the cleaning machine, it passes another ionization bar which neutralizes static charges produced by frictional engagement of the air jets and rotary brushes with the sheet surfaces.

SUMMARY OF INVENTION

Briefly stated, and in accordance with one aspect of the present invention, there is provided a method of removing a plurality of dielectric particles from a sheet before the sheet contacts a photoreceptor at a transfer zone. The method comprises the steps of energizing a plurality of conductors on an insulative belt to create an electric field to attract the dielectric particles on the sheet, de-energizing the conductors, and removing the dielectric particles from the insulative belt.

Pursuant to another aspect of the present invention, there is provided an apparatus for removing a plurality of dielectric particles from a sheet before the sheet contacts a photoreceptor at a transfer zone. This apparatus comprises an insulative belt and a plurality of conductors disposed on the belt. Means are provided for energizing the conductors to create an electric field to attract the dielectric particles on the sheet. Means are provided for de-energizing the conductors. Means are provided for removing the dielectric particles from the insulative belt.

Pursuant to another aspect of the present invention, there is provided a device for removing a plurality of dielectric particles from a sheet before the sheet contacts a photoreceptor at a transfer zone. The device comprises an insulative belt and a plurality of conductors defining a pre-selected pattern on the insulative belt. Means are provided for applying a potential difference to the conductors creating an electric field that attracts dielectric particles from the sheet to said belt.

BRIEF DESCRIPTION OF THE DRAWINGS

Other features of the present invention will become apparent as the following description proceeds and upon reference to the drawings, in which.

While the present invention will be described in connection with a preferred embodiment and method of use thereof, it will be understood that it is not intended to limit the invention to that embodiment or method of use. On the contrary, it is intended to cover all alternatives, modifications, and equivalents as may be included within the spirit and scope of the invention as defined by the appended claims.

DETAILED DESCRIPTION OF THE INVENTION

Figure 4:
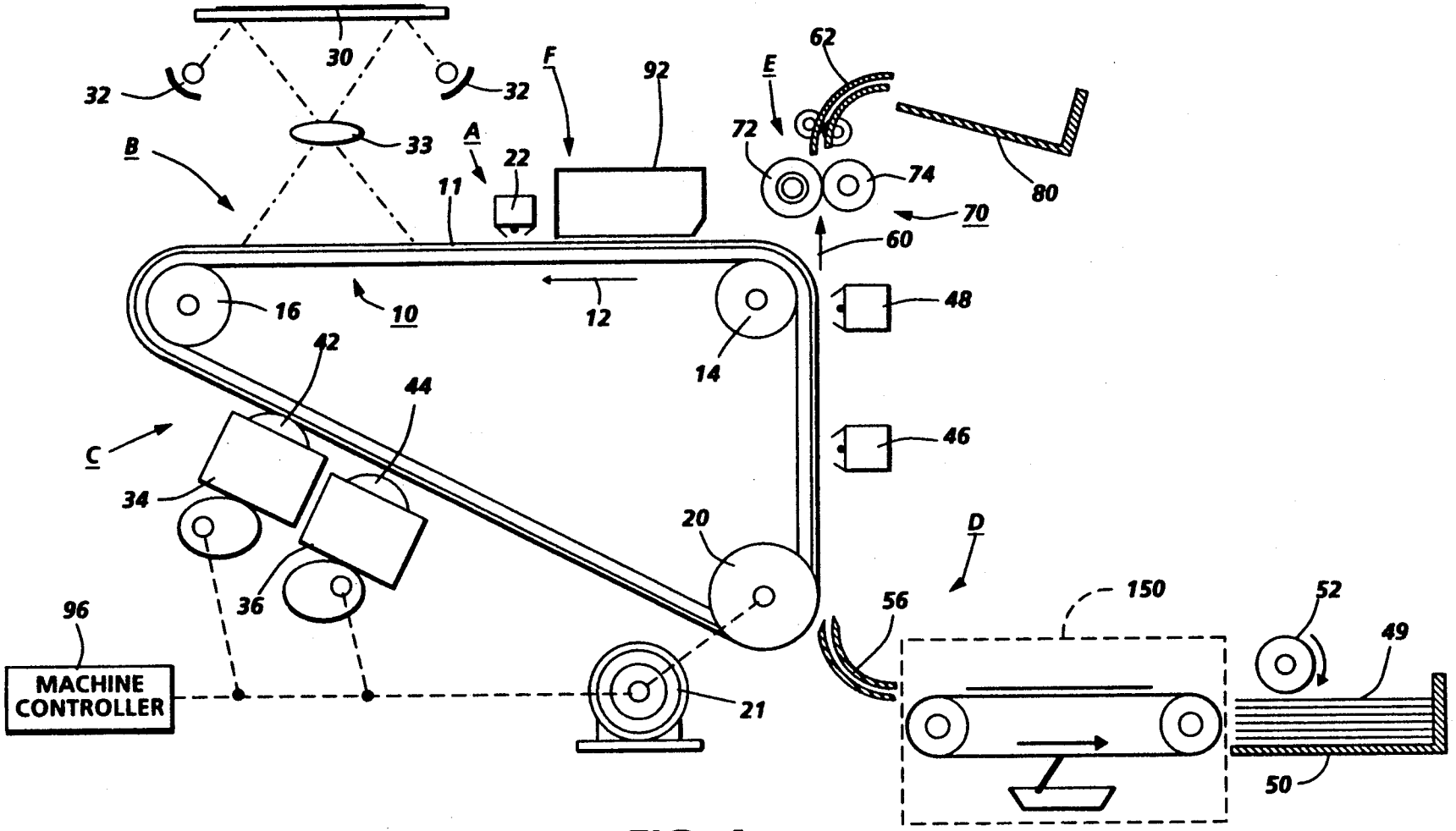
FIG. 4 is a schematic elevational view depicting an electrophotographic printing machine incorporating the features of the present invention therein.

For a general understanding of an electrophotographic printing machine in which the present invention may be incorporated, reference is made to FIG. 4 which depicts schematically the various components thereof. Hereinafter, like reference numerals will be employed throughout to designate identical elements. Although the paper cleaning apparatus of the present invention is particularly well adapted for use in an electrophotographic printing machine, it should become evident from the following discussion, that it is equally well suited for use in a wide variety of devices and is not necessarily limited to the particular embodiments shown herein.

Referring now to the drawings, the various processing stations employed in the reproduction machine illustrated in FIG. 4 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine in which the present invention finds advantageous use utilizes a photoreceptor belt 10, having a photoconductive surface 11. Belt 10 moves in the direction of arrow 12 to advance successive portions of the belt sequentially through the various processing stations disposed about the path of movement thereof. Belt 10 is entrained about stripping roller 14, tension roller 16, and drive roller 20. Drive roller 20 is coupled to a motor 21 by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 4, initially a portion of belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housing 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10. If two colors of developer material are not required, the second developer housing may be omitted.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet from belt 10, whereupon the sheet is stripped from belt 10 at stripping roller 14.

Sheets of support material 49 are advanced to transfer station D from a supply tray 50 after the support material 49 has passed through the paper cleaner subsystem 150. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a backup roller 74 with the toner powder images contacting fuser roller 72. In this manner, the toner powder image is permanently affixed to the sheet, and such sheets are directed via a shoot 62 to an output 80 or finisher.

Residual particles remaining on photoreceptor belt 10 after each copy is made, may be removed at cleaning station F. Removed residual particles may be stored for disposal.

Machine controller 96 is preferably a known programmable controller or combination of controllers, which conventionally control all the machine steps and functions described. Controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention.

It is believed that the foregoing description is sufficient for purposes of the present application to illustrate the general operation of an electrophotographic printing machine which exemplifies one type of apparatus employing the present invention therein. The mechanism for removing paper fibers and dust from the paper sheets will be described hereinafter with reference to FIGS. 1, 2 and 3.

Figure 1:
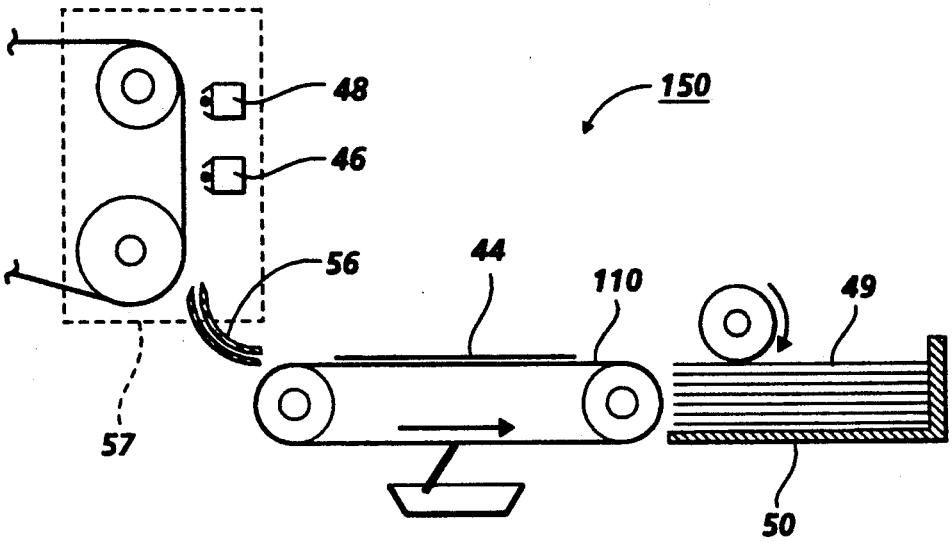
FIG. 1 is an enlarged view of the conductors that create a conductive pattern on the insulative belt.

Referring now to FIG. 1 which shows the paper cleaner subsystem 150. The system consists of an insulative belt 110 with a few independent conductive patterns 100 of the type depicted in FIG. 2. (The conductive patterns 100 vary in size. For example, they can measure $8\frac{1}{2} \times 11$ in. for standard size paper and photoreceptors or wider, such as $11 \times 17$ in. for larger paper and photoreceptors.) The paper sheet 49 is transported from the supply tray 50 onto the insulative belt 110 having conductors 100 (see FIG. 2) arranged in a pattern. To remove debris from the paper sheet 49, prior to xerographic transfer, the conductive pattern 100 (see FIG. 2) is energized to allow the paper sheet 49 to be firmly held in place as it is transported from the supply tray 50 to the photoreceptor belt. Once the paper has been transported to the transfer zone 57, the electric field on the belt 110 is decreased or turned off to release the paper sheet 49. The paper debris that was adhered to the paper sheet 49 remains behind on the insulative belt 110. The insulative belt 110 is then cleaned to remove this residual paper debris. This technique greatly reduces the amount of paper dust entering the xerographic engine. In addition, the absence of abrasive feed rollers serves to cut down the amount of paper dust generated by the copier itself. The concept of the present invention may also be adapted to a vacuumless (unfused) copy transport system.

Figure 2:
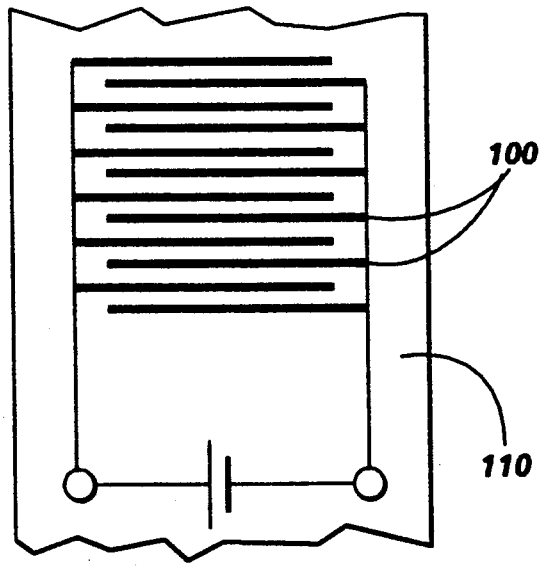
FIG. 2 is an enlarged view illustrating the paper cleaner subsystem.

Referring now to FIG. 2 which shows the conductors 100 arranged in a pattern on the insulative belt 110. Dielectric particles like paper dust and fibers are electrically polarized when subject to an electric field. If the polarizing electric field is uniform, the electric field does not exert any net force on the particle. Electric fields with strong gradients however, can exert large forces (dielectro-phoretic (DEP) forces) on the particles (e.g. dust and paper fibers). The apparatus described herein takes advantage of the attractive force realized by the electric field to retain paper dust and other debris from the paper sheet before it comes into contact with the photoreceptor at the transfer zone 57 (shown in FIG. 1).

With continued reference to FIG. 2, the apparatus of the present invention consists of an insulative (e.g. polyester film) belt 110 that can have the following arrangement or pattern of conductors 100 shown in FIG. 1. A potential difference (i.e. the potential difference can be defined between points A and B as the potential at B less the potential at A, both taken with respect to the same zero of potential) applied to this pattern would set up an electric field between the conductive strips of the conductors 100. The potential difference has a D.C. power source. Due to the geometry, this field would not be uniform and thus, be able to exert an attractive force on small particles. (The non-uniform electric field occurs due to strong multi-polar character.) Preliminary tests have been done using a pattern of six pairs of conductive lines covering approximately $3.5 \times 4.0$ cm of area on a polyester film (e.g. mylar) substrate. This testing indicated that this conductive pattern was very effective in attracting paper dust and fibers. This attractive force can be turned off by removing the potential difference applied to the pattern. It was observed that the electric field can exert up to about 1000 dynes/cm$^2$ pressure on a sheet of paper large enough to prevent paper slip. A typical segment of conductive pattern would have about 0.5 line-pairs/mm and would operate at a potential difference of a few hundred volts.

Figure 3:
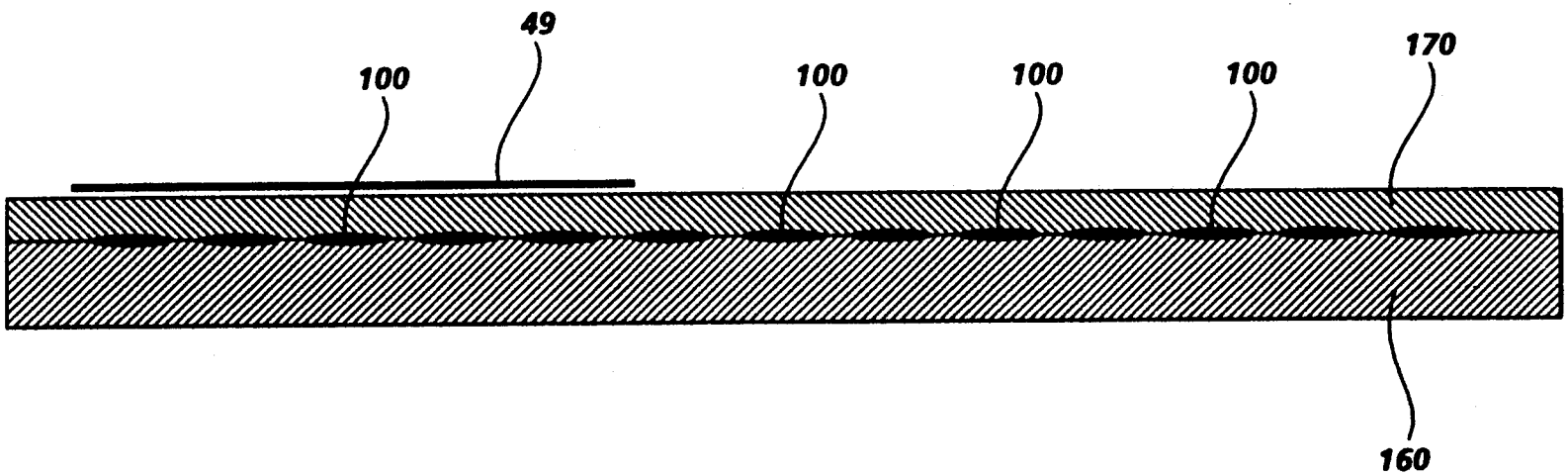
FIG. 3 is a cross-sectional view of the insulative belt.

Referring now to FIG. 3 which shows a cross-section of the insulative belt. A paper sheet 49 rides along a durable dielectric coating 170. (This dielectric coating 170 is not to exceed 0.02 mm.) It is noted that to prevent an electrical break-down through the paper sheet 49 (under high relative humidity conditions), this thin and durable dielectric coating 170 may be applied to the insulative belt to cover the conductive patterns 100. The insulative belt has a thickness of approximately 0.5 mm which is made up of a dielectric substrate 160, a conductive pattern 100 and a durable dielectric coating 170.

In recapitulation, the method of removing particles from the paper sheet in the present invention requires that a non-uniform electric field be created. The electric field is produced by applying a potential difference to the conductors which creates an attractive force. This attractive force holds the paper sheet, paper fibers and other debris in place on the insulative belt. The electric field on the insulative belt is reduced or turned off, which allows release of the paper sheet from the insulative belt as the paper sheet is transported to the transfer zone. The paper fibers and debris remain behind on the belt and are cleaned by a cleaning device (e.g. blade).

It is, therefore, apparent that there has been provided in accordance with the present invention, a paper cleaner subsystem that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of removing a plurality of dielectric particles from a sheet before the sheet contacts a photoreceptor at a transfer zone, comprising the steps of:

energizing a plurality of conductors by applying a potential difference between adjacent conductors on an insulative belt to create an electric field with a non-uniform charge to attract dielectric particles on the sheet to the belt and hold the sheet in position;

de-energizing the conductors; and removing the dielectric particles from the insulative belt.

2. The method of claim 1, wherein said de-energizing step comprises reducing the potential difference applied to the conductors so as to release the sheet for transport to the transfer zone.

3. The method of claim 2, wherein said removing step comprises removing the dielectric particles that remain on the insulative belt after the sheet has contacted the photoreceptor at the transfer zone.

4. An apparatus for removing a plurality of dielectric particles from a sheet before the sheet contacts a photoreceptor at a transfer zone, comprising:

an insulative belt;

a plurality of conductors disposed on said belt;

means for energizing said conductors by applying a potential difference between adjacent conductors to create an electric field with a non-uniform charge to attract the dielectric particles on the sheet to the belt and hold the sheet in position;

means for de-energizing said conductors; and means for removing the dielectric particles from the belt.

5. An apparatus as recited in claim 4, wherein said plurality of conductors comprises conductors arranged in a line pattern adjacently parallel to each other and having a dielectric coating thereon.

6. An apparatus as recited in claim 4, wherein said de-energizing means comprises means for reducing the potential difference applied to said conductors so as to release the sheet for transport to the transfer zone.

7. A device for removing a plurality of dielectric particles from a sheet before the sheet contacts a photoreceptor at a transfer zone, comprising:

an insulative belt;

a plurality of conductors defining a pre-selected pattern on said insulative belt; and means for applying a potential difference between adjacent conductors creating an electric field with a non-uniform charge that attracts dielectric particles from the sheet to said belt.

8. A device as recited in claim 7, wherein said plurality of conductors are located on a side of the insulative belt opposite the sheet.

9. A device as recited in claim 7, wherein said insulative belt comprises a polyester film.

10. A device as recited in claim 8, wherein the plurality of conductors are arranged parallel to one another.

* * * * *